US009586418B2

(12) United States Patent
Tobita

(10) Patent No.: US 9,586,418 B2
(45) Date of Patent: Mar. 7, 2017

(54) RECORDING POSITION CONTROL DEVICE AND ABNORMALITY DETECTING METHOD FOR SAME

(71) Applicant: Katsuhiro Tobita, Kanagawa (JP)

(72) Inventor: Katsuhiro Tobita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/922,801

(22) Filed: Oct. 26, 2015

(65) Prior Publication Data

US 2016/0114576 A1 Apr. 28, 2016

(30) Foreign Application Priority Data

Oct. 27, 2014 (JP) ..... 2014-218319

(51) Int. Cl.

| | |
|---|---|
| ***B41J 2/045*** | (2006.01) |
| ***B41J 11/00*** | (2006.01) |
| ***B41J 2/21*** | (2006.01) |
| ***B41J 25/00*** | (2006.01) |

(52) U.S. Cl.

CPC ..... *B41J 11/0095* (2013.01); *B41J 2/2146* (2013.01); *B41J 25/001* (2013.01)

(58) Field of Classification Search

CPC . B41J 2/2135; B41J 2/155; B41J 2/515; B41J 2/04505; B41J 25/001

See application file for complete search history.

(56) References Cited

U.S. PATENT DOCUMENTS

| | | | | |
|---|---|---|---|---|
| 4,675,696 A * | 6/1987 | Suzuki | B41J 2/2135 346/46 |
| 5,041,850 A * | 8/1991 | Kahoyashi | B41J 11/703 347/157 |
| 7,309,118 B2 * | 12/2007 | Mizes | B41J 2/2135 347/19 |

(Continued)

FOREIGN PATENT DOCUMENTS

| | | |
|---|---|---|
| JP | 2005-022134 | 1/2005 |
| JP | 2010-137489 | 6/2010 |

(Continued)

*Primary Examiner* — Stephen Meier
*Assistant Examiner* — John P Zimmermann
(74) *Attorney, Agent, or Firm* — Harness, Dickey & Pierce, P.L.C.

(57) ABSTRACT

A recording position control device includes head units, edge sensors, head movers, a controller, and a timer. The controller performs an original-point determination operation of moving the head units to an original point and to control the head movers to move the head units in a direction to correct meandering of a recording medium. The controller performs a second round of the original-point determination operation after performing a first round of the original-point determination operation. The timer measures, as a measurement time period, a time period from when the controller issues an execution command of the second round to when the controller receives a completion status of the second round. In a case in which the measurement time period is equal to or shorter than a first threshold time period, the controller determines that the original-point determination operation of the head units has failed to be normally executed.

16 Claims, 4 Drawing Sheets

(56) References Cited

U.S. PATENT DOCUMENTS

| | | | | |
|---|---|---|---|---|
| 8,075,086 | B2 * | 12/2011 | Mizes | B41J 3/543 347/19 |
| 2002/0126169 | A1 * | 9/2002 | Wyngaert | B41J 2/155 347/12 |
| 2010/0150632 | A1 * | 6/2010 | Matsumoto | B41J 2/515 399/395 |
| 2015/0009262 | A1 | 1/2015 | Bell et al. | |
| 2015/0290931 | A1 * | 10/2015 | Boland | B41J 2/04505 347/14 |

FOREIGN PATENT DOCUMENTS

| | | |
|---|---|---|
| JP | 2010-149377 | 7/2010 |
| JP | 2011-131551 | 7/2011 |
| JP | 2011-136526 | 7/2011 |
| JP | 2015-013476 | 1/2015 |

* cited by examiner

RECORDING POSITION CONTROL DEVICE AND ABNORMALITY DETECTING METHOD FOR SAME

CROSS-REFERENCE TO RELATED APPLICATION

This patent application is based on and claims priority pursuant to 35 U.S.C. §119(a) to Japanese Patent Application No. 2014-218319, filed on Oct. 27, 2014, in the Japan Patent Office, the entire disclosure of which is hereby incorporated by reference herein.

BACKGROUND

Technical Field

Aspects of this disclosure relate to a recording position control device and an abnormality detecting method for the recording position control device.

Related Art

In recent years, line-scanning-type inkjet printing apparatuses have enhanced print speed and image quality. Taking advantages of on-demand printing, print businesses in commercial and industrial fields have been on the rise.

In such a large-size inkjet printing apparatus, head units corresponding to different colors, e.g., cyan (C), magenta (M), yellow (Y), and black (K) are arranged in a sheet conveyance direction at certain intervals. For example, in a large-size inkjet printing apparatus, the distance between a head unit on the upstream side and a head unit on the downstream side can be several meters.

In addition, some types of recording media may have large meandering. If a recording medium meanders, landing positions of ink droplets discharged from a head unit on the upstream side and a head unit on the downstream side shift from each other. Consequently, the color registration accuracy of cyan (C), magenta (M), yellow (Y), and black (K) colors decreases, thus causing a decrease in print image quality.

SUMMARY

In an aspect of the present disclosure, there is provided a recording position control device that includes a plurality of head units, a plurality of edge sensors, a plurality of head movers, a controller, and a timer. The plurality of head units is arranged in a conveyance direction of a recording medium, to discharge ink droplets on to the recording medium to form an image on the recording medium. The plurality of edge sensors detects a meandering amount of the conveyed recording medium in conveyance. The plurality of head movers is mounted on the head units, respectively, to finely move the head units in a main scanning direction. The controller performs an original-point determination operation of moving the head units to an original point, which is a reference position of the head units, and to control the head movers to move the head units in a direction to correct meandering of the recording medium, according to the meandering amount detected based on outputs of the edge sensors. The timer measures a time period from when the controller outputs an execution command of a movement to the head movers to when the controller receives from the head movers a completion status indicating that the movement is completed. The controller performs a second round of the original-point determination operation after performing a first round of the original-point determination operation. The timer measures, as a measurement time period, a time period from when the controller issues an execution command of the second round of the original-point determination operation to when the controller receives a completion status of the second round of the original-point determination operation. In a case in which the measurement time period is equal to or shorter than a first threshold time period, the controller determines that the original-point determination operation of the head units has failed to be normally executed.

In an aspect of the present disclosure, there is provided an abnormality detecting method includes performing once an original-point determination operation of moving a head unit to an original point, which is a reference position of the head unit; performing a second round of the original-point determination operation after performing a first round of the original-point determination operation; measuring, with a timer, a time period from when an issuance of an execution command of the second round of the original-point determination operation to a receipt of a completion status of the second round of the original-point determination operation, as a measurement time period; and determining that the original-point determination operation of the head unit has failed to be normally executed, in a case in which the measurement time period is equal to or shorter than a threshold time period.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
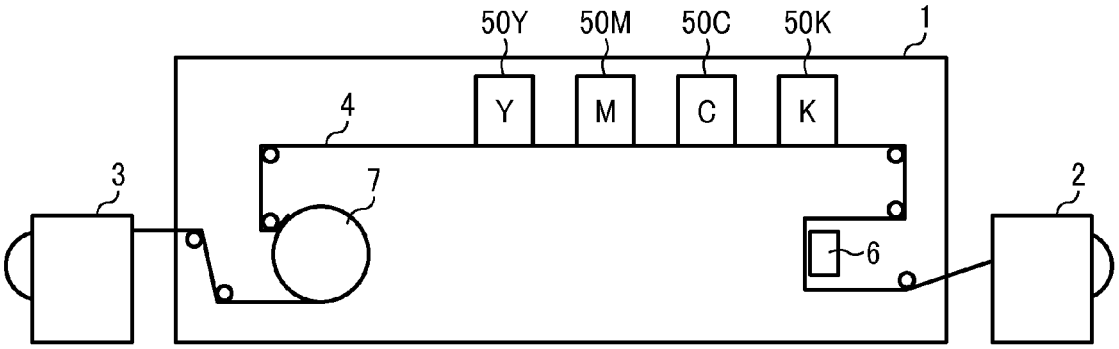
FIG. 1 is a side view of a system configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

For example, there has been proposed a technique of detecting a meandering amount of a recording medium by a sensor for detecting an end of a recording medium, and according to the detected meandering amount, finely moving head units of the respective colors in a direction perpendicular to a sheet conveyance direction, i.e., in a main scanning direction.

In this technique, a recording position correcting device includes an actuator to finely move the head units. When a controller transmits a movement command to the actuator, the actuator starts an operation of moving the head units to positions designated by the controller. Upon completing the moving operation, the actuator transmits a completion status to the controller. In conventional recording position correcting devices, the controller determines the completion of the moving operation only based on such a completion status.

If, however, unexpected vibration, increased load, or the like is applied to the actuator, the actuator may transmit the completion status without normally completing the moving operation. In this case, there has been such a problem that abnormal states of the positions of head units cannot be detected even though printing positions of the head units shift from one another. This problem causes a trouble particularly in an original-point determination operation of the actuator because an erroneous position of an original point results in printing misregistration.

As described below, according to at least one embodiment of the present disclosure, there can be provided a recording position correcting device that can detect, with accuracy and at low cost, an abnormality in a moving operation of an actuator.

Hereinafter, a recording position control device according to an embodiment of the present disclosure and an abnormality detecting method of the same will be described with reference to the drawings.

FIG. 1 is a side view illustrating a system configuration of an image forming apparatus 1 according to the present embodiment. As illustrated in FIG. 1, the system configuration of the image forming apparatus 1 includes the image forming apparatus 1, a sheet feed device 2, and a sheet ejection device 3.

Internal main components of the image forming apparatus 1 include a plurality of head units 50, an edge control 6, and a heat roll 7. The plurality of head units 50 includes a yellow head unit 50Y, a magenta head unit 50M, a cyan head unit 50C, and a black head unit 50K.

The sheet feed device 2 feeds a rolled recording medium 4 to the edge control 6.

The edge control 6 regulates the positions of both width-direction ends of the fed recording medium. The edge control 6 thereby corrects the tilt of the recording medium in a main scanning direction (a direction perpendicular to a conveyance direction of the recording medium) so as to suppress the meandering of the recording medium.

The yellow head unit 50Y, the magenta head unit 50M, the cyan head unit 50C, and the black head unit 50K are arranged in order in the conveyance direction of the recording medium at the downstream of the edge control 6 in the recording-medium conveyance direction, so as to discharge ink droplets (recording materials) of the respective colors onto the conveyed recording medium.

The heat roll 7 heats the recording medium and thereby dries ink discharged onto the recording medium.

The sheet ejection device 3 rolls up the recording medium on which an image is formed.

As described above, the meandering of the recording medium is suppressed by the edge control 6. Nevertheless, some types of recording media have large degrees of meandering. In the case of such recording media, recording position deviation of several hundreds of microns may be generated between a black color of the black head unit 50K arranged at the uppermost stream in the recording-medium conveyance direction and a yellow color of the yellow head unit 50Y arranged at the downmost stream in the recording-medium conveyance direction.

Figure 2:
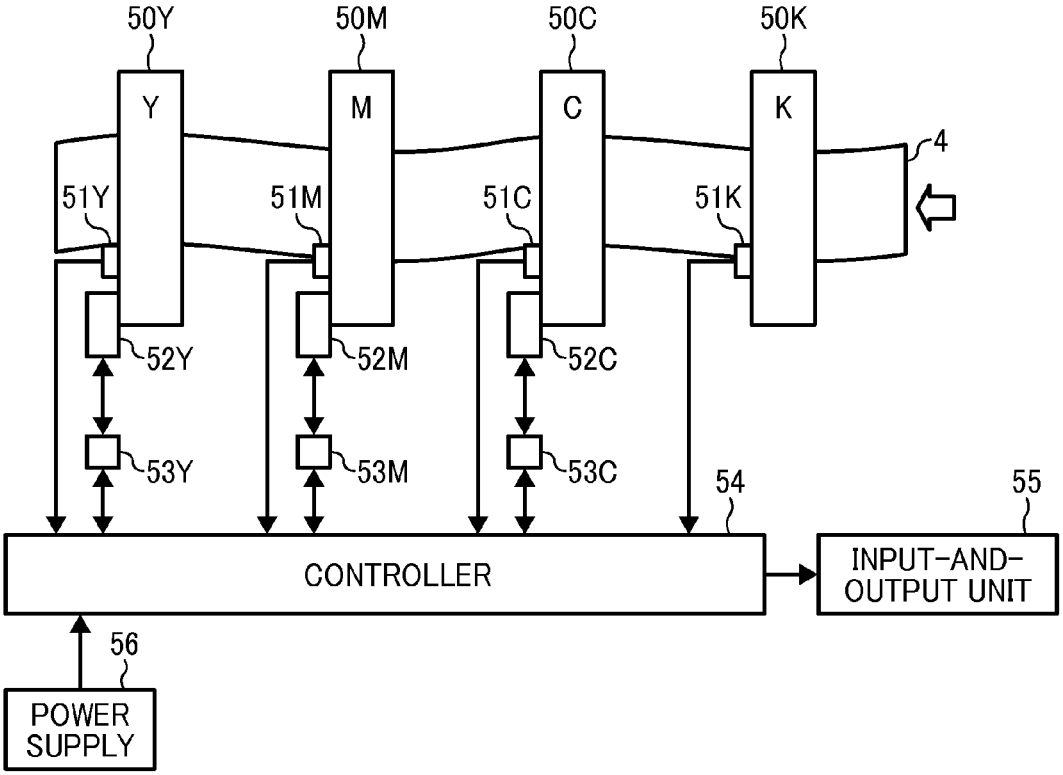
FIG. 2 is a plan view of a configuration of a recording position correcting device according to an embodiment of the present disclosure.

FIG. 2 is a plan view illustrating a configuration of a recording position correcting device. As illustrated in FIG. 2, a recording position correcting device serving as an embodiment of a recording position control device 150 is arranged inside the image forming apparatus 1. The recording position correcting device includes a yellow edge sensor 51Y, a magenta edge sensor 51M, a cyan edge sensor 51C, and a black edge sensor 51K in the vicinity of the yellow head unit 50Y, the magenta head unit 50M, the cyan head unit 50C, and the black head unit 50K, respectively.

The recording position correcting device includes a Y actuator 52Y, an M actuator 52M, and a C actuator 52C to finely move the yellow head unit 50Y, the magenta head unit 50M, and the cyan head unit 50C, respectively.

The recording position correcting device includes a Y control 53Y, an M control 53M, and a C control 53C to control the Y actuator 52Y, the M actuator 52M, and the C actuator 52C, respectively.

The recording position correcting device includes a controller 54 including an arithmetic unit. The controller 54 connects to an input-and-output unit 55 such as a control panel that is included in the image forming apparatus 1, and to a power source 56.

The yellow edge sensor 51Y, the magenta edge sensor 51M, the cyan edge sensor 51C, and the black edge sensor 51K each include a light emitting unit that emits laser light, and a light receiving unit (e.g., charge-coupled device (CCD) sensor) that is arranged facing the light emitting unit and receives laser light.

The controller 54 inputs output signals of the yellow edge sensor 51Y, the magenta edge sensor 51M, the cyan edge sensor 51C, and the black edge sensor 51K each serving as an edge detector. The controller 54 detects the edge of the recording medium 4 by detecting the change in the output of the light receiving unit from ON to OFF or OFF to ON.

In the present embodiment, a head unit serving as a reference to detect meandering of the recording medium is assumed to be the black head unit 50K positioned at the uppermost stream in the recording-medium conveyance direction. Thus, the controller 54 detects a meandering amount with reference to output of the black edge sensor 51K.

The controller 54 detects a meandering amount of the recording medium by comparing edge positions of the recording medium that are detected by the yellow edge sensor 51Y, the magenta edge sensor 51M, and the cyan edge sensor 51C, with an edge position detected by the black edge sensor 51K.

The Y actuator 52Y, the M actuator 52M, and the C actuator 52C connect to corresponding head units, i.e., the yellow head unit 50Y, the magenta head unit 50M, and the cyan head unit 50C, respectively, via fixing members.

The Y actuator 52Y, the M actuator 52M, and the C actuator 52C each include a servomotor. The rotary movement of this servomotor is converted into a linear movement via a ball screw mechanism. This displaces the positions of the corresponding head units, i.e., the yellow head unit 50Y, the magenta head unit 50M, and the cyan head unit 50C.

The controller 54 issues a command such as a movement command to the Y control 53Y, the M control 53M, and the C control 53C, to thereby displace, to arbitrary positions, the corresponding head units, i.e., the yellow head unit 50Y, the magenta head unit 50M, and the cyan head unit 50C.

The Y control 53Y, the M control 53M, and the C control 53C are connected to the controller 54 via an interface such as a universal serial bus (USB) or an RS232C interface. The controller 54 performs overall control in the following manner. Based on the meandering amount of the recording medium that is obtained from the yellow edge sensor 51Y, the magenta edge sensor 51M, the cyan edge sensor 51C, and the black edge sensor 51K, the controller 54 issues a movement command to the Y control 53Y, the M control 53M, and the C control 53C so as to finely move the yellow head unit 50Y, the magenta head unit 50M, the cyan head unit 50C, and the black head unit 50K.

The input-and-output unit 55 includes switch keys for alphanumeric characters to input control parameters, and a display to display an error and the like.

The power source 56 supplies a voltage of +5 V for the controller 54, and a voltage of +24 V to drive the Y actuator 52Y, the M actuator 52M, and the C actuator 52C.

Figure 3:
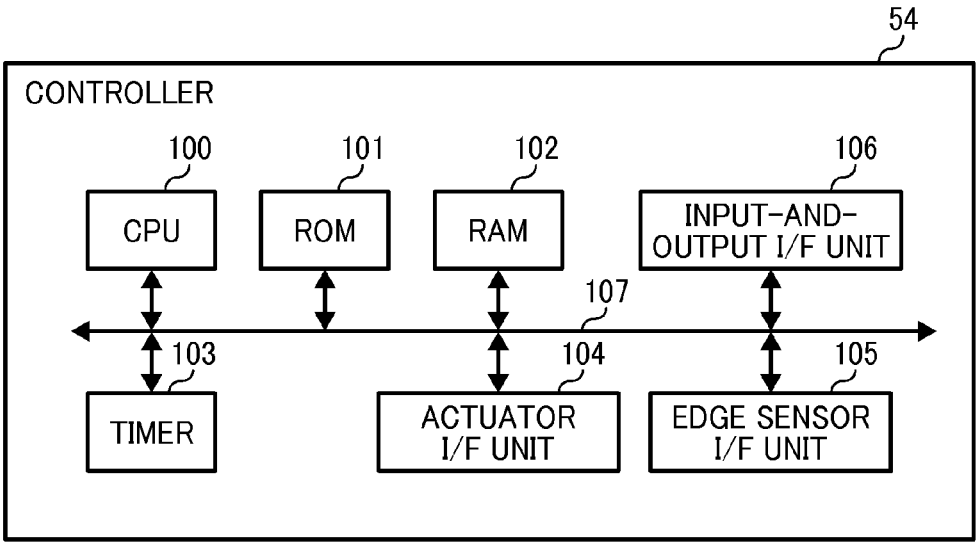
FIG. 3 is a block diagram of a configuration of a controller according to an embodiment of the present disclosure.

FIG. 3 is a block diagram illustrating a configuration of the controller 54. As illustrated in FIG. 3, the controller 54 includes a central processing unit (CPU) 100 serving as an arithmetic unit, a read-only memory (ROM) 101 and a random access memory (RAM) 102 each serving as a storage device, a timer 103 serving as a time measuring unit, an actuator interface unit 104 (hereinafter, interface is referred to as "I/F."), an edge sensor I/F unit 105, and an input-and-output I/F unit 106.

The controller 54 includes the CPU 100 and a peripheral circuit thereof, and is connected to each device via a bus 107.

The ROM 101 stores a program, and is an electrically-rewritable flash ROM. The RAM 102 is used as a work area of a program, or the like. The timer 103 is used to count time, or the like.

The actuator I/F unit 104 is an interface to perform communication with the Y control 53Y, the M control 53M, and the C control 53C. As an interface protocol, the USB, the RS232C, or the like is used.

The edge sensor I/F unit 105 connects to the yellow edge sensor 51Y, the magenta edge sensor 51M, the cyan edge sensor 51C, and the black edge sensor 51K. The input-and-output I/F unit 106 includes an input-and-output (I/O) port to connect to the input-and-output unit 55, and the like.

Hereinafter, the yellow head unit 50Y, the magenta head unit 50M, the cyan head unit 50C, and the black head unit 50K will be collectively referred to as a head unit 50. In addition, hereinafter, the Y actuator 52Y, the M actuator 52M, and the C actuator 52C, each serving as a head mover, will be collectively referred to as an actuator 52. Hereinafter, the Y control 53Y, the M control 53M, and the C control 53C will be collectively referred to as a control 53.

Figure 4:
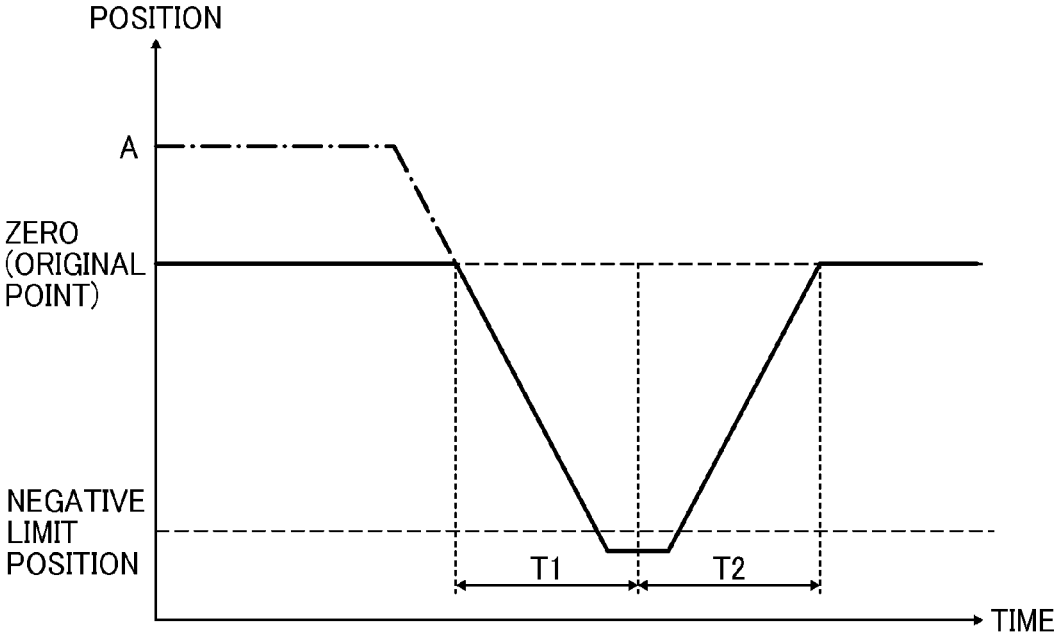
FIG. 4 is a diagram of a state of an original-point determination operation of an actuator according to an embodiment of the present disclosure.

FIG. 4 is a diagram illustrating a state of an original-point determination operation of the actuator 52. The vertical axis indicates the displacement amount of the head unit 50, and the horizontal axis indicates time.

First, an original-point determination operation is necessary to perform relative movement control and absolute value movement control by the actuator 52. An original point is a reference position used when the servomotor or the like performs a positioning operation. An operation of determining such an original point is the original-point determination operation. The original-point determination operation starts upon a command for executing the original-point determination operation being issued from the controller 54 to the control 53. The head unit 50 connected to the actuator 52 moves to an original point serving as a reference position.

As illustrated in FIG. 4, a negative limit position is on the minus side (negative side) of a zero position, and is a limit position up to which the head unit 50 can move toward the minus side (negative side). This negative limit position is detected by a mechanical switch, an optical sensor, or the like.

In a state in which the power of the recording position correcting device is shut off, the position of the head unit 50 may be moved from the position at which the head unit 50 stops before the power is shut off, for maintenance of the head or other similar reasons. Thus, when the original-point determination operation is performed first after the power is turned ON, the stop position of the head unit 50 cannot be determined. FIG. 4 illustrates a case in which the head unit 50 is at the zero position and a case in which the head unit 50 is at a stop at an A point which is on the positive side of the zero position. Here, the positive side refers to a direction from the negative limit position, which is a limit position up to which the head unit 50 can move, toward the original point.

First, acceleration, deceleration (mm/s2), and the like are set to perform the original-point determination operation. Specifically, a command is transmitted from the controller 54 to the control 53, and parameters such as acceleration are set.

Next, when the controller 54 issues, to the control 53, a command for executing the original-point determination operation, the head unit 50 connected to the actuator 52 starts to move toward the negative side from the zero position or the A point.

Upon detecting above-described negative limit position, the actuator 52 temporarily stops. Since a movement speed is set to be constant, a time period T1 from when the actuator 52 moves from the zero position to when the actuator 52 temporarily stops upon detecting the negative limit position is approximately constant.

After the actuator 52 temporarily stops, the actuator 52 starts to move toward the plus side (positive side), and stops upon detecting the zero position. A movement time period T2 from when the actuator 52 moves from the negative limit position to when the actuator 52 reaches the zero position is approximately constant as well.

There are various methods for the actuator 52 detecting the zero position. As an example, use of a method of using a home pulse of an encoder attached to the shaft of the servomotor, i.e., one signal generated through one rotation enables a highly-accurate original-point determination operation. In addition, if the zero position is detected, an increment counter used for relative movement control and the like is set to zero. Then, the actuator 52 transmits, to the controller 54, a completion status indicating that the original-point determination operation normally ends.

If, however, an external factor such as unexpected vibration and increased load is applied during the movement process of the actuator 52, the actuator 52 may stop in the vicinity of the negative limit position and the actuator 52 may not report a completion status, or the actuator 52 may misrecognize the vicinity of the negative limit position as the zero position, and the actuator 52 may transmit a completion status.

For example, some sort of load may be applied while the head unit 50 is being moved toward the negative limit position. In this case, control is performed so that large current flows by the servomotor. If large current flows by the servomotor, vibration is generated in the servomotor. Since the encoder is attached to the shaft of the servomotor, due to the generated vibration, the actuator 52 erroneously detects, instead of the actual zero position, a home pulse generated in the vicinity of the negative limit position, as the zero position. The actuator 52 accordingly transmits a completion status to stop.

Thus, if the completion of the original-point determination operation is determined only based on the completion status from the actuator 52, the position of the original point is erroneously determined.

In view of the foregoing, the original-point determination operation in the present embodiment utilizes the fact that a time period required for a reciprocating operation of moving until the negative limit position is detected and moving from the negative limit position to the zero position is approximately constant. Specifically, in addition to the confirmation of a completion status from the actuator 52, the controller 54 measures a time period from when a movement command of an original-point determination operation is issued to the actuator 52 to when a movement completion status is received from the actuator 52.

The controller 54 determines that a moving operation is halfway stopped if the measured time period is equal to or shorter than a predetermined threshold time period. As a result, even if the actuator 52 erroneously transmits a completion status, a moving state of the head unit 50 can be accurately detected.

A specific method for measuring a time period is as follows. Since the stop position of the actuator 52 cannot be determined when the power is shut off, a first round of the original-point determination operation is executed to identify the stop position of the head unit 50, thereby identifying the stop position of the head unit 50. As a specific position, for example, the head unit 50 is identified as being at the zero position or in the vicinity of the negative limit position.

Next, a second round of the original-point determination operation is executed to measure a time period, thereby measuring a time period from when an execution command of the second round of the original-point determination operation is issued to when a completion status of the round of the original-point determination operation is received. Then, the measured time period is compared with a predetermined threshold time period.

A threshold time period for determining whether the original-point determination operation is normally completed is determined considering variation in an execution time period of the original-point determination operation. The threshold time period is preferably in such a range that the threshold time period is longer than the time period T1 and shorter than a sum of the time periods T1 and T2. For example, the threshold time period is preferably set to (T1+T2/2). Such a threshold time period is prestored in the ROM 101.

If the controller 54 determines an abnormality, the controller 54 recovers positional deviation by performing a recovery sequence including performing a third round of the original-point determination operation after returning the actuator 52 to the positive side, e.g., a position in the vicinity of the zero position. If the original-point determination operation is not normally completed even though this recovery sequence is performed a predetermined number of times, an abnormality is determined, and an error message is displayed on the input-and-output unit 55.

In the present embodiment, the controller 54 determines that an original-point determination operation is normally completed, if a time period from when an execution command of the original-point determination operation is issued to when a completion status of the original-point determination operation is received is longer than a predetermined threshold time period. Thus, if the time period is equal to or shorter than a threshold time period, even though the head unit 50 has returned to the original point, the third round of the original-point determination operation is performed so as to confirm that the time period from when an execution command of the original-point determination operation is issued to when a completion status of the original-point determination operation is received is longer than a predetermined threshold time period. Through such control, the controller 54 can avoid erroneously determining that an original-point determination operation is normally completed even though the original-point determination operation has failed.

As another embodiment, the above-described predetermined threshold time period may be determined to be used in the following manner. An individual value is determined based on individual values adjusted during the manufacturing stage of the actuator 52, the determined value is input from the input-and-output unit 55, and the input value is stored in the ROM 101 as a threshold value.

Figure 5:
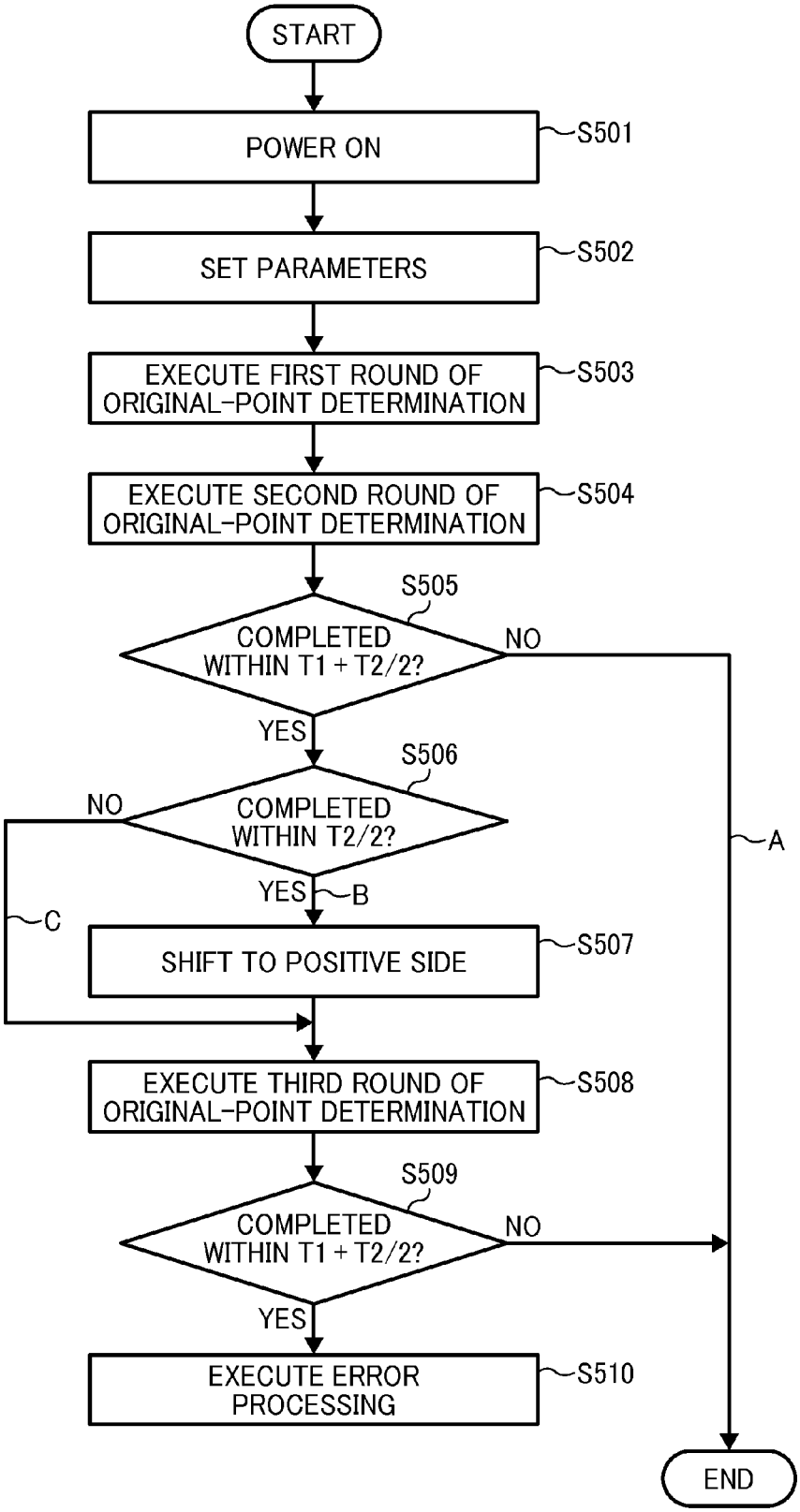
FIG. 5 is a flowchart of an operation of a recording position correcting device according to an embodiment of the present disclosure.

FIG. 5 is a flowchart illustrating an operation of the recording position correcting device. As illustrated in FIG. 5, in step S501, the controller 54 turns ON the power of +24 V to drive the actuator 52.

In step S502, the controller 54 sets, in the actuator 52, parameters such as acceleration, speed, and a movement range that are used when the head unit 50 is moved.

In step S503, the controller 54 issues, to the actuator 52, a command for instructing the execution of the first round of the original-point determination operation to determine the stop position of the head unit 50. At this time, a time period is not measured. The head unit 50 stops at the original point if the original-point determination operation succeeds, or stops in the vicinity of the negative limit position if the original-point determination operation fails.

In step S504, the controller 54 issues a command for instructing the execution of a second round of the original-point determination operation. The controller 54 measures a time period from when the command for instructing the execution of the second round of the original-point determination operation is issued to the actuator 52 to when a completion status of the original-point determination operation is received from the actuator 52.

Specifically, when the controller 54 transmits, to the actuator 52, the command for instructing the execution of the second round of the original-point determination operation, the controller 54 also starts the timer 103 to start measuring the time period. Upon receiving a completion status of the original-point determination operation from the actuator 52, the controller 54 stops the timer 103, and stores the measured time period into the RAM 102.

In step S505, the controller 54 determines whether the measured time period is within a first threshold time period, i.e., T1+T2/2. If the controller 54 determines that the measured time period is within the first threshold time period, the controller 54 determines that the original-point determination operation is halfway stopped, and the processing proceeds to step S506. If the controller 54 determines that the measured time period exceeds the first threshold time period, the controller 54 determines that the original-point determination operation is normally completed, and the processing ends.

In step S506, the controller 54 determines whether the measured time period is within a second threshold time period. The second threshold time period is shorter than the time period T2 required for the actuator 52 returning from the negative limit position to the original point. The second threshold time period can be set to T2/2, for example. If the controller 54 determines that the measured time period is within the second threshold time period, the controller 54 determines that the head unit 50 stops in the vicinity of the negative limit position, and the processing proceeds to step S507. If the controller 54 determines that the measured time period exceeds the second threshold time period, the controller 54 determines that the head unit 50 stops at the original point, and the processing proceeds to step S508.

In step S507, the controller 54 forcibly moves the head unit 50 that stops in the vicinity of the negative limit position, to the vicinity of the zero position.

The method for forcibly moving the head unit 50 to the vicinity of the zero position is performed according to a command for detecting a positive limit and a stop command. Through this operation, an operation point of a switch for detecting a negative limit can be separated from a home pulse position of the encoder to determine the zero position. This brings about an effect of preventing the above-described erroneous detection of the zero position.

In step S508, the controller 54 issues, to the actuator 52, a command for instructing the execution of a third round of the original-point determination operation.

When the controller 54 transmits, to the actuator 52, the command for instructing the execution of the third round of the original-point determination operation, the controller 54 also resets and restarts the timer 103 to start measuring a time period. Upon receiving a completion status of the original-point determination operation from the actuator 52, the controller 54 stops the timer 103, and stores the measured time period into the RAM 102.

In step S509, the controller 54 determines whether the measured time period is within the first threshold time period. If the controller 54 determines that the measured time period is within the first threshold time period, the controller 54 determines that the original-point determination operation is halfway stopped, and the processing proceeds to step S510. If the controller 54 determines that the measured time period exceeds the first threshold time period, the controller 54 determines that the original-point determination operation is normally completed, and the processing ends.

In step S510, the controller 54 outputs an indication of an error to the input-and-output unit 55, and the processing ends.

Figure 6:
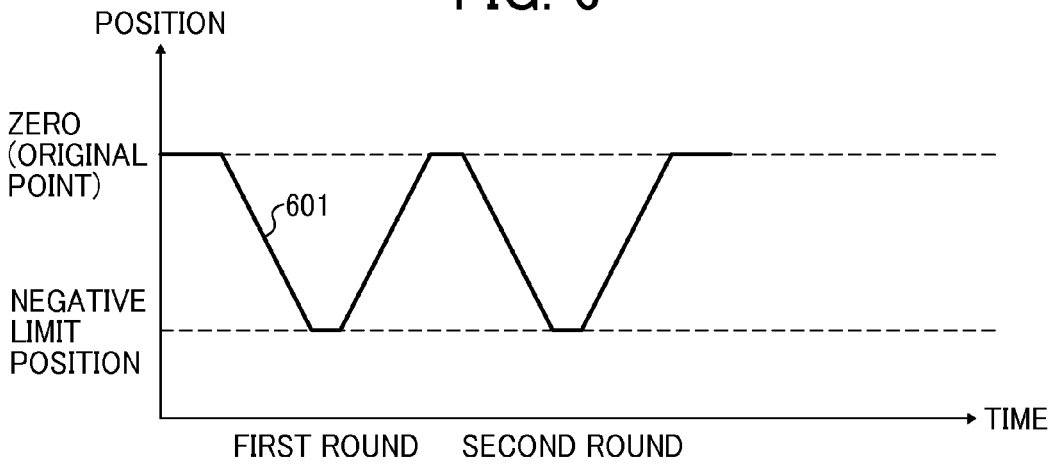
FIG. 6 is a diagram of a position of a head unit and a time period that are obtainable when an original-point determination operation is normally performed.

FIG. 6 is a diagram illustrating a position of the head unit 50 and a time period that are obtainable when an original-point determination operation is normally performed. The vertical axis indicates the position of the head unit 50, and the horizontal axis indicates time. As indicated by a graph 601 in FIG. 6, in a normal original-point determination operation, i.e., in a flow A illustrated in FIG. 5, two rounds of reciprocation from the original point to the negative limit position is performed in a row.

Figure 7:
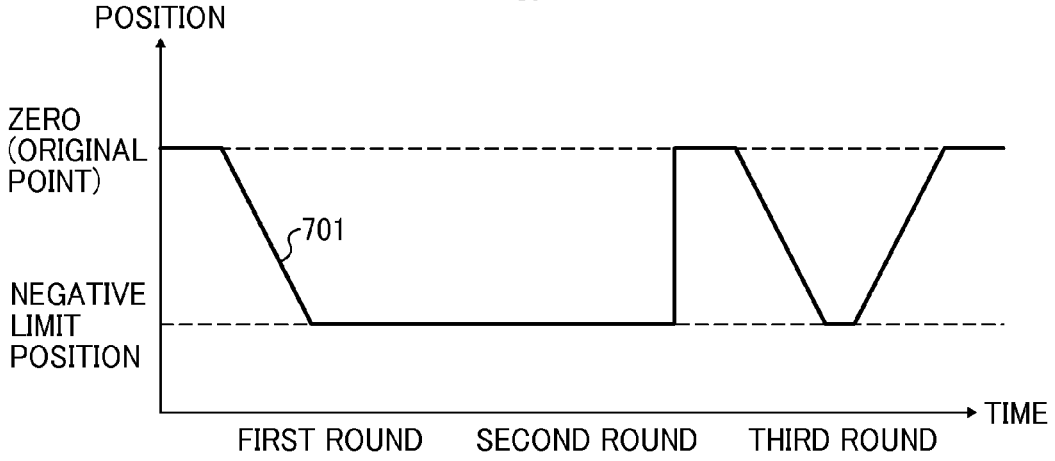
FIG. 7 is a diagram of a first pattern in which an abnormality of a first round of the original-point determination operation is recovered.

FIG. 7 is a diagram illustrating a first pattern in which an abnormality of the first round of the original-point determination operation is recovered. As indicated by a graph 701 in FIG. 7, in a case in which the head unit 50 stops in the vicinity of the negative limit position in the first round of the original-point determination operation, i.e., in a flow B illustrated in FIG. 5, the controller 54 forcibly returns the head unit 50 to the vicinity of the original point, and then, performs the third round of the original-point determination operation.

Figure 8:
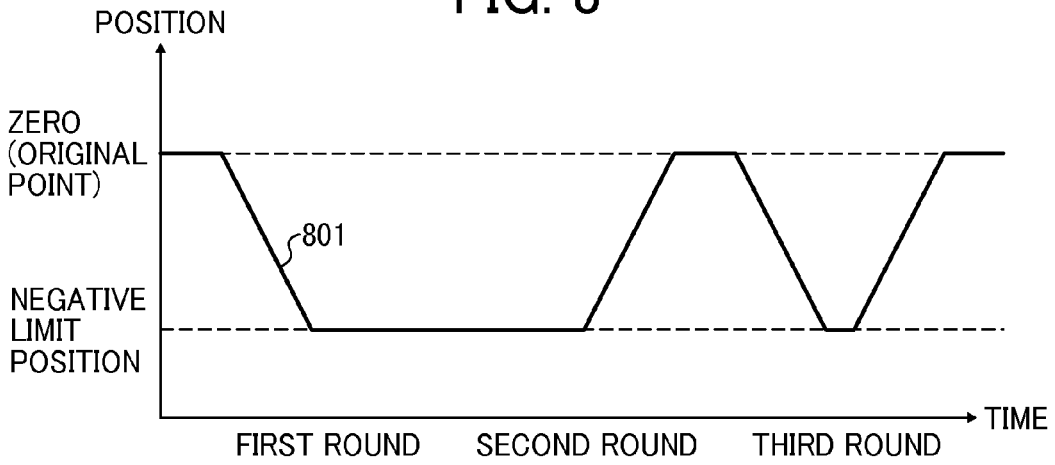
FIG. 8 is a diagram of a second pattern in which an abnormality of a first round of the original-point determination operation is recovered.

FIG. 8 is a diagram illustrating a second pattern in which an abnormality of the first round of the original-point determination operation is recovered. As indicated by a graph 801 in FIG. 8, in a case in which the head unit 50 stops in the vicinity of the negative limit position in the first round of the original-point determination operation, but the head unit 50 moves to original point by the second round of the original-point determination operation, i.e., in a flow C illustrated in FIG. 5, the controller 54 performs the third round of the original-point determination operation without performing an operation of forcibly returning the head unit 50 to the vicinity of the original point.

Thus, in any cases, a time period required for the normally executed original-point determination operation is longer than the first threshold time period. It is therefore detectable that original-point determination operation is accurately performed.

As described above, the recording position correcting device according to the present embodiment includes the controller 54 to determine whether or not a movement of the head unit 50, such as an original-point determination operation, is normally executed, based on a time period from when a command for starting the movement is issued to the actuator 52 to when a completion status is received, in addition to whether or not the completion status is received from the actuator 52.

There can be accordingly provided a recording position correcting device that can detect, with accuracy and at low cost, an abnormality in an operation, such as an original-point determination operation, of the actuator 52 to finely move the head unit 50, without adding an external sensor or the like.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A recording position control device, comprising:

a plurality of head units arranged in a conveyance direction of a recording medium, to discharge ink droplets on to the recording medium to form an image on the recording medium;

a plurality of edge sensors to detect a meandering amount of the conveyed recording medium in conveyance;

a plurality of head movers mounted on the head units, respectively, to finely move the head units in a main scanning direction;

a controller to perform an original-point determination operation of moving the head units to an original point, which is a reference position of the head units, and to control the head movers to move the head units in a direction to correct meandering of the recording medium, according to the meandering amount detected based on outputs of the edge sensors; and a timer to measure a time period from when the controller outputs an execution command of a movement to the head movers to when the controller receives from the head movers a completion status indicating that the movement is completed, wherein the controller is configured to perform a second round of the original-point determination operation after performing a first round of the original-point determination operation, wherein the timer is configured to measure, as a measurement time period, a time period from when the controller issues an execution command of the second round of the original-point determination operation to when the controller receives a completion status of the second round of the original-point determination operation, and wherein in a case in which the measurement time period is equal to or shorter than a first threshold time period, the controller is configured to determine that the original-point determination operation of the head units has failed to be normally executed.

2. The recording position control device according to claim 1, wherein in a case in which the controller determines that the second round of the original-point determination operation has failed to be normally executed, the controller is configured to move the head units from a negative limit position, which is a limit position up to which the head units are movable, toward a positive side, which is a direction toward the original point, and then executes a third round of the original-point determination operation.

3. The recording position control device according to claim 2, wherein in a case in which the controller determines that the second round of the original-point determination operation has failed to be normally executed, and the measurement time period is longer than a second threshold time period, which is shorter than a time period from when the head movers detect the negative limit position to when the head movers return to the original point, the controller is configured to perform the third round of the original-point determination operation without moving the head units toward the positive side.

4. The recording position control device according to claim 2, wherein in a case in which the controller determines that the original-point determination operation of the head units has failed to be normally executed even if an operation of moving the head units toward the positive side and then executing the original-point determination operation is performed a predetermined number of times, the controller is configured to output an indication of an operational abnormality.

5. The recording position control device according to claim 4, wherein in a case in which the original-point determination operation has been normally performed, the first threshold time period is longer than a first time period from when the controller issues the execution command of the second round of the original-point determination operation to when the head movers detect the negative limit position, and shorter than a second time period until when the head units further return to the original point after the head movers detect the negative limit position.

6. An abnormality detecting method, comprising:

performing once an original-point determination operation of moving a head unit to an original point, which is a reference position of the head unit;

performing a second round of the original-point determination operation after performing a first round of the original-point determination operation;

measuring, with a timer, a time period from when an issuance of an execution command of the second round of the original-point determination operation to a receipt of a completion status of the second round of the original-point determination operation, as a measurement time period; and determining that the original-point determination operation of the head unit has failed to be normally executed, in a case in which the measurement time period is equal to or shorter than a threshold time period.

7. An image forming apparatus, comprising:

a plurality of head units arranged in a conveyance direction of a recording medium, to discharge ink droplets on to the recording medium to form an image on the recording medium;

a plurality of sensors to detect meandering of the conveyed recording medium in conveyance;

a plurality of actuators mounted on the head units, respectively, to move the head units in a main scanning direction;

a controller to perform an original-point determination operation of moving the head units to an original point, which is a reference position of the head units, and to control the actuators to move the head units in a direction to correct the meandering of the recording medium, according to the meandering detected based on outputs of the sensors; and a timer to measure a time period from when the controller outputs an execution command of a movement to the actuators to when the controller receives a completion status indicating that the movement is completed, wherein the controller is configured to perform a second round of the original-point determination operation after performing a first round of the original-point determination operation, wherein the timer is configured to measure, as a measurement time period, a time period from when the controller issues an execution command of the second round of the original-point determination operation to when the controller receives a completion status of the second round of the original-point determination operation, and wherein in a case in which the measurement time period is equal to or shorter than a first threshold time period, the controller is configured to determine that the original- point determination operation of the head units has failed to be normally executed.

8. The image forming apparatus according to claim 7, wherein the sensor is an edge sensor.

9. The abnormality detecting method according to claim 6, further comprising:

moving the head units from a negative limit position, in a case in which the second round of the original-point determination operation is determined to have failed to have been normally executed, the negative limit position being a limit position up to which the head units are movable, toward a positive side, which is a direction toward the original point, and thereafter executing a third round of the original-point determination operation.

10. The abnormality detecting method according to claim 9, further comprising:

performing the third round of the original-point determination operation without moving the head units toward the positive side, in a case in which the second round of the original-point determination operation is determined to have failed to have been normally executed, and the measurement time period is longer than a second threshold time period, which is shorter than a time period from when the head movers detect the negative limit position to when the head movers return to the original point.

11. The abnormality detecting method according to claim 9, further comprising:

outputting an indication of an operational abnormality in a case in which it is determined that the original-point determination operation of the head units has failed to be normally executed, after an operation of moving the head units toward the positive side and then executing the original-point determination operation is performed a number of times.

12. The abnormality detecting method according to claim 11, wherein in a case in which the original-point determination operation has been normally performed, the first threshold time period is longer than a first time period from when a command of the second round of the original-point determination operation is executed to when the head movers detect the negative limit position, and shorter than a second time period until when the head units further return to the original point after the head movers detect the negative limit position.

13. The recording position control device according to claim 7, wherein in a case in which the controller determines that the second round of the original-point determination operation has failed to be normally executed, the controller is configured to move the head units from a negative limit position, which is a limit position up to which the head units are movable, toward a positive side, which is a direction toward the original point, and then executes a third round of the original-point determination operation.

14. The recording position control device according to claim 13, wherein in a case in which the controller determines that the second round of the original-point determination operation has failed to be normally executed, and the measurement time period is longer than a second threshold time period, which is shorter than a time period from when the head movers detect the negative limit position to when the actuators return to the original point, the controller is configured to perform the third round of the original-point determination operation without moving the head units toward the positive side.

15. The recording position control device according to claim 13, wherein in a case in which the controller determines that the original-point determination operation of the head units has failed to be normally executed even if an operation of moving the head units toward the positive side and then executing the original-point determination operation is performed a predetermined number of times, the controller is configured to output an indication of an operational abnormality.

16. The recording position control device according to claim 15, wherein in a case in which the original-point determination operation has been normally performed, the first threshold time period is longer than a first time period from when the controller issues the execution command of the second round of the original-point determination operation to when the actuators detect the negative limit position, and shorter than a second time period until when the head units further return to the original point after the head movers detect the negative limit position.

* * * * *